US007325306B2

(12) United States Patent
Twigg

(10) Patent No.: US 7,325,306 B2
(45) Date of Patent: Feb. 5, 2008

(54) METHOD OF MANUFACTURING A FIBRE REINFORCED METAL MATRIX COMPOSITE ARTICLE AND A CASSETTE FOR USE THEREIN

(75) Inventor: Edwin S Twigg, Derby (GB)

(73) Assignee: Rolls-Royce plc, London (GB)

( * ) Notice: Subject to any disclaimer, the term of this patent is extended or adjusted under 35 U.S.C. 154(b) by 555 days.

(21) Appl. No.: 10/988,641

(22) Filed: Nov. 16, 2004

(65) Prior Publication Data

US 2005/0103827 A1 May 19, 2005

(30) Foreign Application Priority Data

Nov. 18, 2003 (GB) ..... 0327044.4

(51) Int. Cl.
*B21D 53/78* (2006.01)
*B21K 3/04* (2006.01)
*B23P 15/02* (2006.01)

(52) U.S. Cl. ..... 29/889.71; 29/464; 29/784; 29/799

(58) Field of Classification Search ..... 29/889.71, 29/430, 771, 784, 799, 788, 281.4, 889.7, 29/889.2, 464
See application file for complete search history.

(56) References Cited

U.S. PATENT DOCUMENTS 2,688,776 A 9/1954 Evans
4,782,992 A 11/1988 Doble
4,900,599 A * 2/1990 Doble ..... 428/64.1
5,184,769 A * 2/1993 Moracz et al. ..... 228/121
5,427,304 A * 6/1995 Woods et al. ..... 228/190
5,562,245 A 10/1996 Berthelemy et al.
5,946,801 A * 9/1999 Twigg et al. ..... 29/889.71
6,658,715 B1 * 12/2003 Podesta' ..... 29/419.1

FOREIGN PATENT DOCUMENTS

EP 529953 A 3/1993
EP 0 831 154 A 3/1998

* cited by examiner

*Primary Examiner*—David P. Bryant
*Assistant Examiner*—Christopher M Koehler
(74) *Attorney, Agent, or Firm*—W. Warren Taltavull; Manelli Denison & Selter PLLC

(57) ABSTRACT

A method of manufacturing a fibre reinforced metal matrix composite article (10) comprises forming an annular groove (32) in the first metal component (30), forming a second metal component (36) and forming a number of fibre preforms (20). The fibre preforms (20) are placed in an annular channel (80) in a cassette (70). The cassette (70) and the first metal component (30) are arranged such that the annular channel (80) in the cassette (70) is coaxial with and faces the annular groove (32) in the first metal component (30). The fibre preforms (20) are moved from the annular channel (80) in the cassette (70) to the annular groove (32) in the first metal component (30). The second metal component (36) is placed on the first metal component (30) such that the fibre preforms (20) are arranged between the first metal component (30) and the second metal component (36). The second metal component (36) is sealed to the first metal component (30). Heat and pressure is applied such as to consolidate the fibre preforms (20) and to diffusion bond the filler metal, the first metal component (30) and the second metal component (36) to form a unitary composite component.

29 Claims, 12 Drawing Sheets

METHOD OF MANUFACTURING A FIBRE REINFORCED METAL MATRIX COMPOSITE ARTICLE AND A CASSETTE FOR USE THEREIN

The present invention relates to a method of manufacturing a fibre reinforced metal matrix composite article, and the present invention relates in particular to a method of manufacturing a fibre reinforced metal matrix composite rotor, for example fibre reinforced metal matrix rings and fibre reinforced metal matrix composite discs. The present invention relates particularly to fibre reinforced metal matrix composite discs and fibre reinforced metal matrix composite rings which are suitable for use in gas turbine engines as blade carrying compressor, or turbine, rotors.

In one known method of manufacturing a fibre reinforced metal matrix composite article, as disclosed in European patent No. EP0831154B1, a plurality of metal-coated fibres are placed in an annular groove in a metal ring and a metal ring is placed on top of the metal-coated fibres. Each of the metal-coated fibres is wound in a plane and the metal-coated fibre spirals are stacked in the annular groove in the metal ring. The metal ring is pressed predominantly axially to consolidate the assembly and to diffusion bond the metal rings and the metal-coated fibre spirals together to form an integral structure.

In a further known method of manufacturing a fibre reinforced metal matrix composite article, as disclosed in European patent application No. EP1288324A2, the arrangement described in EP0831154B1 is modified by the inclusion of metal wires in the annular groove in the metal ring with the metal-coated fibres. Each of the metal wires is wound spirally in a plane and the metal wire spirals are stacked in the annular groove in the metal ring with the metal-coated fibre spirals.

A problem with these methods of manufacturing fibre reinforced metal matrix composite articles is that the metal-coated fibre spirals, or metal-coated fibre spirals and metal wire spirals, are difficult to handle manually when they have relatively large diameters because the metal-coated fibre spirals and metal wire spirals are too flexible and too fragile. The manual loading of the metal-coated fibre spirals and metal wire spirals individually into the annular groove in the metal ring may result in damage and/or contamination of the metal-coated fibre spirals and metal wire spirals. Also, the manual loading of the metal-coated fibre spirals and metal wire spirals is difficult and time consuming and hinders volume assembly.

Accordingly the present invention seeks to provide a novel method of manufacturing a fibre reinforced metal matrix composite article.

Accordingly the present invention provides a method of manufacturing a fibre reinforced metal matrix composite article, the method comprising the steps of:—

(a) forming a first metal component, forming a groove in the first metal component,
(b) forming a second metal component,
(c) forming at least one fibre preform, the fibre preform comprising at least one fibre,
(d) placing the at least one fibre preform on a cassette, the cassette having a channel to receive the at least one fibre preform,
(e) arranging the cassette and the first metal component such that the channel in the cassette is aligned with and faces the groove in the first metal component,
(f) moving the at least one fibre preform from the channel in the cassette to the groove in the first metal component, (g) placing the second metal component on the first metal component such that the at least one fibre preform and filler metal are arranged between the first metal component and the second metal component,
(h) sealing the second metal component to the first metal component,
(i) applying heat and pressure such as to consolidate the at least one fibre preform and the filler metal and to diffusion bond the filler metal, the first metal component and the second metal component to form a unitary composite component.

Preferably the method comprises the steps of:—

(a) forming a first metal component, forming an annular groove in the first metal component,
(b) forming a second metal component,
(c) forming at least one fibre preform, the fibre preform comprising at least one fibre,
(d) placing the at least one fibre preform on a cassette, the cassette having an annular channel to receive the at least one fibre preform,
(e) arranging the cassette and the first metal component such that the annular channel in the cassette is coaxial with and faces the annular groove in the first metal component,
(f) moving the at least one fibre preform from the annular channel in the cassette to the annular groove in the first metal component,
(g) placing the second metal component on the first metal component such that the at least one fibre preform and a filler metal are arranged in the annular groove between the first metal component and the second metal component,
(h) sealing the second metal component to the first metal component,
(i) applying heat and pressure such as to consolidate the at least one fibre preform and the filler metal and to diffusion bond the filler metal, the first metal component and the second metal component to form a unitary composite component.

Preferably the cassette comprises an annular base member, a first ring and a second ring, the first ring and second ring being mounted coaxially on the annular base member to define the annular channel.

Preferably the first ring is segmented. Preferably the second ring is segmented.

Preferably the cassette comprises an annular liner positioned between the first ring and the second ring, the at least one fibre preform being positioned on the annular liner.

Preferably step (f) comprises moving the annular liner axially relative to the cassette and the first metal component so as to move the at least one fibre preform from the annular channel in the cassette to the annular groove in the first metal component.

Preferably the method comprises removing the segments of the second ring from the cassette after step (d) and before step (e).

Preferably the first ring has at least one projection and the first metal component has an annular recess to maintain the cassette in the correct position relative to the first metal component.

Preferably the annular base member has a plurality of circumferentially arranged apertures arranged between the first ring and the second ring.

Preferably the method comprises inserting pins through the apertures in the annular base plate and securing the pins to the annular liner.

Preferably step (f) comprises moving the pins axially relative to the first metal component such as to move the annular liner and the fibre preforms towards and into the annular groove in the first metal component.

Preferably the method comprises removing the annular base plate and the first ring to leave the annular liner and pins in the annular groove in the first metal component.

Preferably the method comprises removing the annular liner and the pins from the annular groove in the first metal component.

Preferably step (e) comprises arranging the open end of the annular channel in the cassette such that it faces vertically upwards and that the open end of the annular groove in the first metal component faces vertically downwards.

Preferably the method comprises after step (f) and before step (g) inverting the cassette and the first metal component such that the annular channel in the cassette faces vertically downwards and the annular groove in the first metal component faces vertically upwards.

Preferably step (c) comprises forming at least one metal wire preform, step (d) comprises placing the at least one fibre preforms and the at least one metal wire preform in the annular channel in the cassette and step (f) comprises moving the at least one fibre preform and the at least one metal wire preform from the annular channel in the cassette to the annular groove in the first metal component.

Preferably there are a plurality of fibre preforms.

Preferably the sealing of the edges of the at least two metal components may be by welding the edges of the at least two metal components together.

Preferably the method comprises forming an annular projection on the second metal component and placing the annular projection of the second metal component in the annular groove in the first metal component.

Preferably the at least one fibre is a silicon carbide fibre, a silicon carbide fibre, a boron fibre or an alumina fibre.

Preferably the at least one fibre is a metal-coated fibre.

Preferably the metal-coated fibre is titanium-coated fibre, a titanium aluminide coated fibre or a titanium alloy coated fibre.

Preferably the fibre preform is formed by winding at least one fibre on a former to form a spiral fibre preform.

Preferably the filler metal comprises at least one metal wire.

Preferably the at least one metal wire is a wire preform.

Preferably the wire preform is formed by winding at least one metal wire on a former to form a spiral wire preform.

Preferably the at least one metal wire is a titanium wire, a titanium aluminide wire or a titanium alloy wire.

Preferably the method comprises storing the at least one fibre preform on the cassette.

The present invention also provides a cassette for use in a method of manufacturing a fibre reinforced metal matrix composite article, the cassette comprising a base member, a first member and a second member, the first member and second member being mounted on the base member to define a channel to receive at least one fibre preform.

Preferably the cassette comprises an annular base member, a first ring and a second ring, the first ring and second ring being mounted coaxially on the annular base member to define an annular channel to receive at least one fibre preform.

Preferably the first ring is segmented. Preferably the second ring is segmented.

Preferably the first ring and the second ring extend axially from the annular base plate and the first ring and the second ring are radially spaced.

Preferably the cassette comprises an annular liner positioned between the first ring and the second ring, the at least one fibre preform being positionable on the annular liner, the annular liner is movable axially relative to the annular base plate and first and second rings.

Preferably the annular base member has a plurality of circumferentially arranged apertures arranged between the first ring and the second ring.

Preferably a plurality of pins are provided, each pin extends through a respective one of the apertures in the annular base plate and the pins are removably secured to the annular liner.

Alternatively the first ring and the second ring extend radially from the annular base plate and the first ring and the second ring are axially spaced.

Preferably the first ring has at least one projection.

Preferably the annular base member comprises a metal. Preferably the first ring comprises poly methyl methacrylate. Preferably the second ring comprises poly methyl methacrylate. Preferably the annular liner comprises poly methyl methacrylate.

Preferably one of the first and second rings are removably mounted on the annular base member.

The present invention will be more fully described by way of example with reference to the accompanying drawings, in which.

Figure 1:
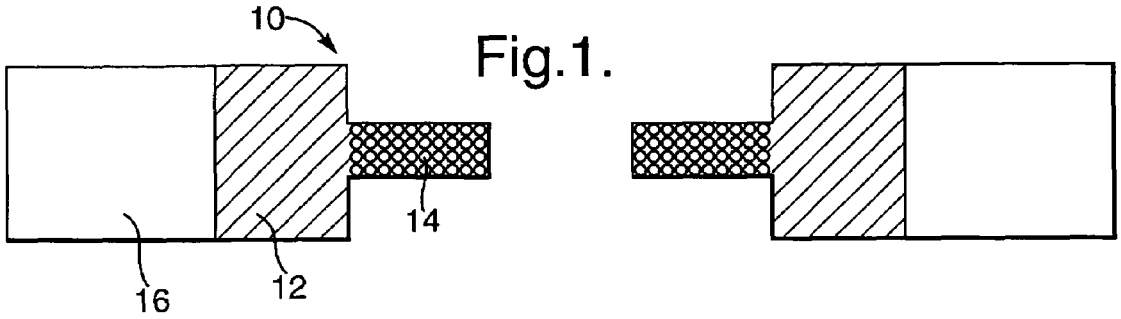
FIG. 1 is a longitudinal, axial, cross-sectional view through a bladed compressor rotor made according to the present invention.

A finished ceramic fibre reinforced metal rotor 10 with integral rotor blades is shown in FIG. 1. The rotor 10 comprises a metal ring 12, which includes a ring of circumferentially extending reinforcing ceramic fibres 14, which are embedded in the metal ring 12. A plurality of solid metal rotor blades 16 are circumferentially spaced on the metal ring 12 and extend radially outwardly from and are integral with the metal ring 12.

Figure 2:
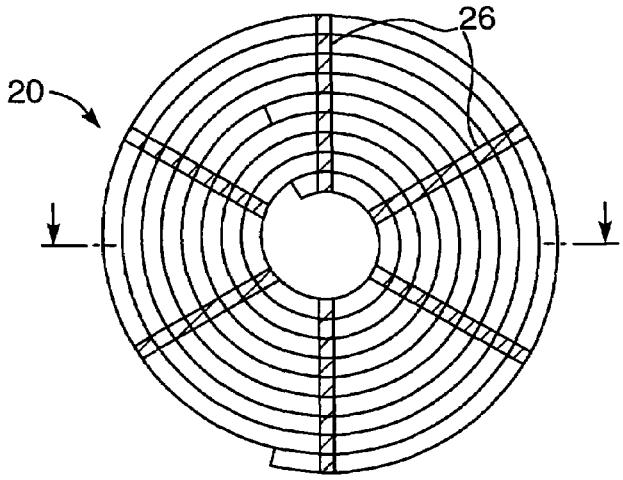
FIG. 2 is a plan view of a fibre preform used in the method of the present invention.
Figure 3:
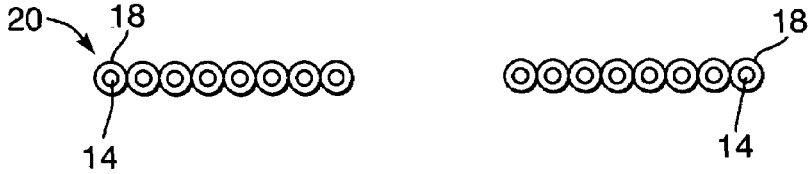
FIG. 3 is a cross-sectional view through the preform shown in FIG. 2.

A ceramic fibre reinforced metal rotor 10 is manufactured using a plurality of metal-coated ceramic fibres. Each ceramic fibre 14 is coated with metal matrix 18 by any suitable method, for example physical vapour deposition, sputtering etc. Each metal-coated 18 ceramic fibre 14 is wound around a mandrel to form an annular, or disc shaped, fibre preform 20 as shown in FIGS. 2 and 3. Each annular, or disc shaped, fibre preform 20 thus comprises a single metal-coated ceramic fibre 14 arranged in a spiral with adjacent turns of the spiral abutting each other. A glue 22 is applied to the annular, or disc shaped, fibre preform 20 at suitable positions to hold the turns of the spiral together. The glue is selected such that it may be completely removed from the annular, or disc shaped, fibre preform 20 prior to consolidation. The glue may be for example polymethylmethacrylate in dichloromethane (Perspex (RTM) in dichloromethane).

Figure 4:
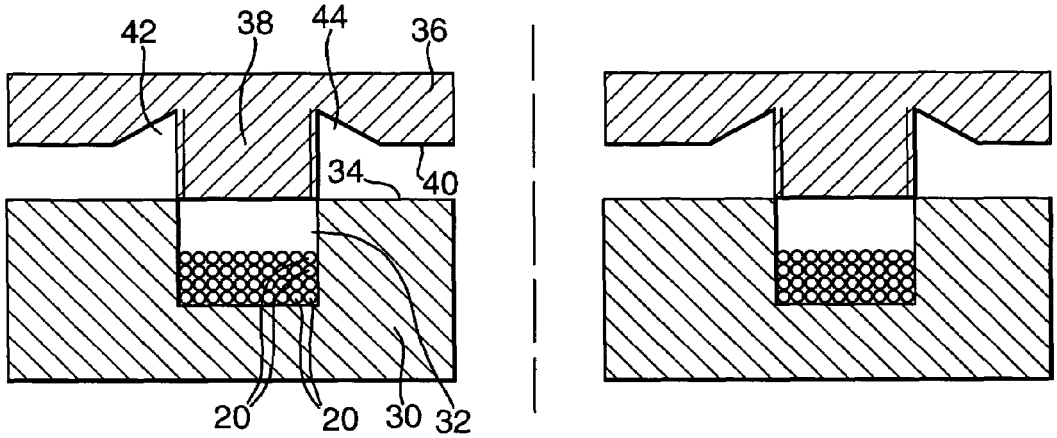
FIG. 4 is a longitudinal, axial, cross-sectional view through an assembly of fibre preforms positioned between first and second metal rings.

A first metal ring, or metal disc, 30 is formed and an annular axially extending groove 32 is machined in one radially extending axially facing face 34 of the first metal ring 30, as shown in FIG. 4. The annular groove 32 has straight parallel sides, which form a rectangular cross-section. A second metal ring, or metal disc, 36 is formed and an annular axially extending projection 38 is machined from the second metal ring, or metal disc, 36 such that it extends from one radially extending axially facing face 40 of the second metal ring, or metal disc 36. The second metal ring, or metal disc, 36 is also machined to form two annular grooves 42 and 44 in the face 40 of the second metal ring, or metal disc, 36. The annular grooves 42 and 44 are arranged radially on opposite sides of the annular projection 38 and the annular grooves 42 and 44 are tapered radially from the face 40 to the base of the annular projection 38. It is to be noted that the radially inner and outer dimensions, diameters, of the annular projection 38 are substantially the same as the radially inner and outer dimensions, diameters, of the annular groove 32.

One or more of the annular fibre preforms 20 are positioned coaxially in the annular groove 32 in the face 34 of the first metal ring 30. The radially inner and outer dimensions, diameters, of the annular fibre preforms 20 are substantially the same as the radially inner and outer dimensions, diameters, of the annular groove 32 to allow the annular fibre preforms 20 to be loaded into the annular groove 32 while substantially filling the annular groove 32. A sufficient number of annular fibre preforms 20 are stacked in the annular groove 32 to partially fill the annular groove 32 to a predetermined level.

Figure 5:
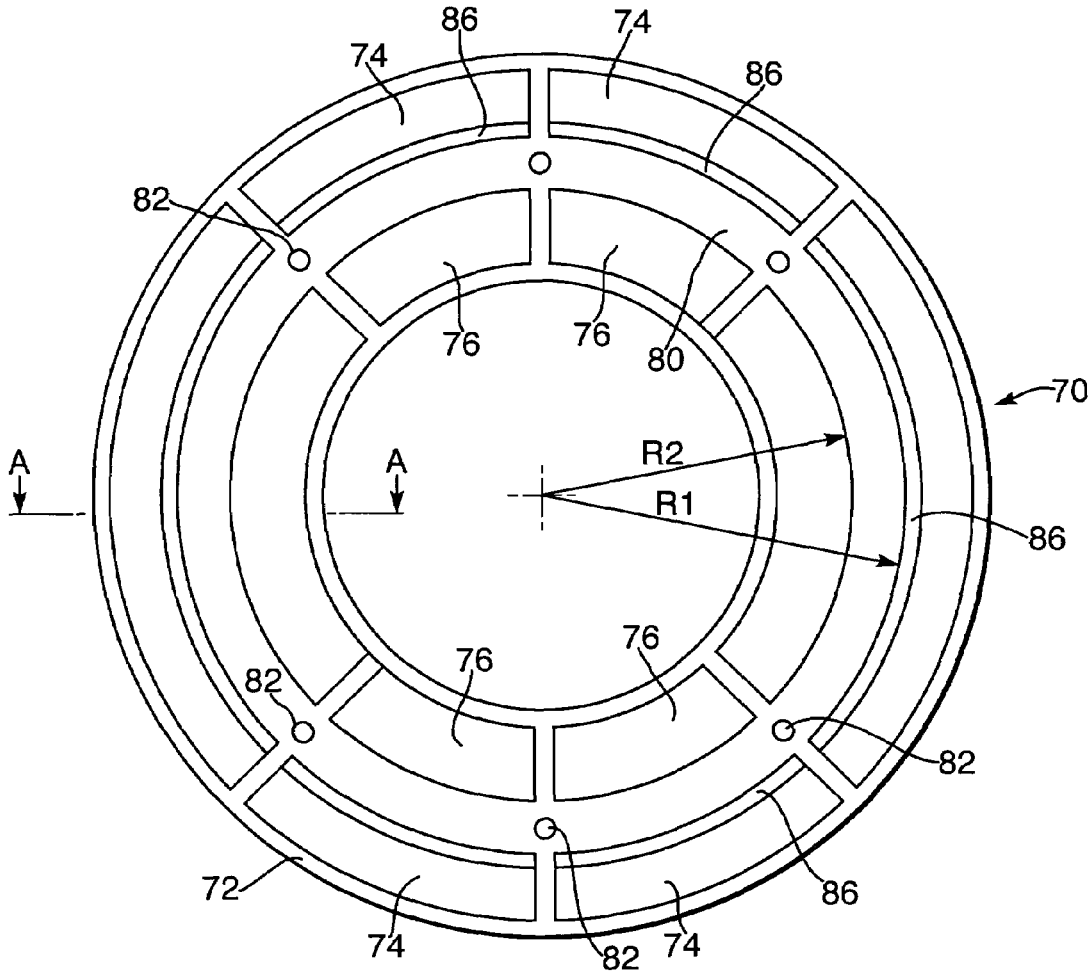
FIG. 5 is a plan view of a cassette used in the method of the present invention.
Figure 6:
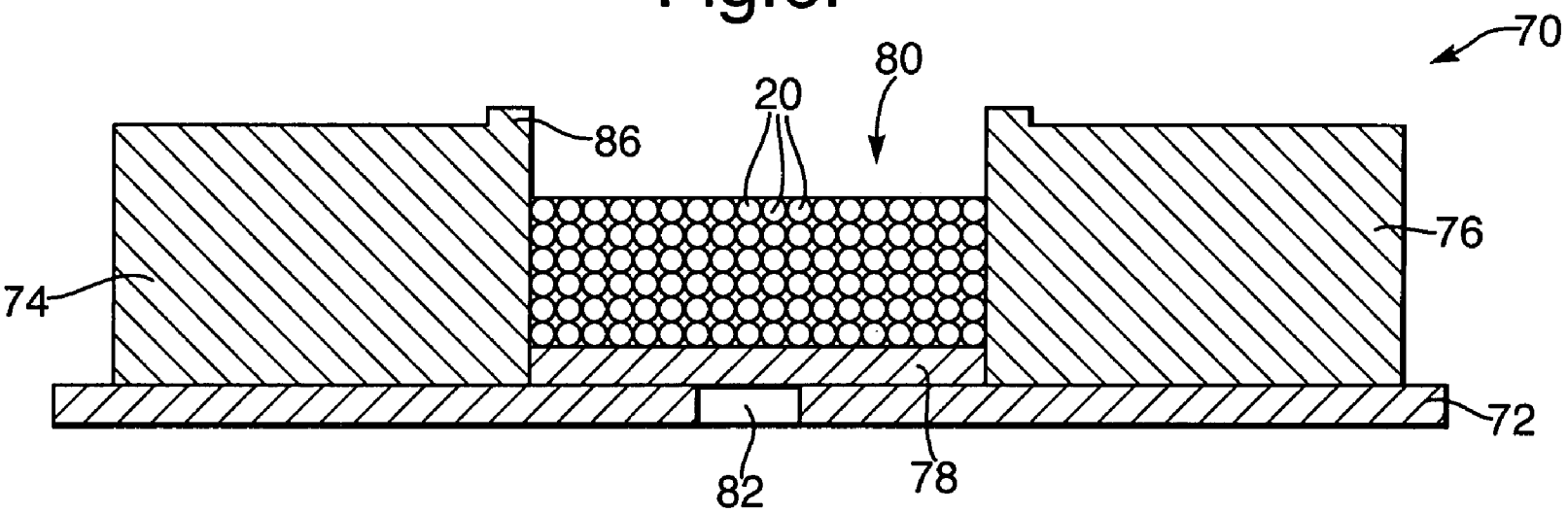
FIG. 6 is an enlarged longitudinal, axial, cross-sectional view through the cassette shown in FIG. 5 containing a plurality of fibre preforms shown in FIG. 2.

A cassette 70 is used to position the annular fibre preforms 20 in the annular groove 32 in the face 34 of the first metal ring 30. The cassette 70, as shown in FIGS. 5 and 6, comprises an annular base plate 72, a first set of segments 74, a second set of segments 76 and an annular liner 78. The first set of segments 74 is arranged at a first radius on the annular base plate 72 and the second set of segments 76 is arranged at a second radius on the annular base plate 72 and the first radius is greater than the second radius. The inner dimension/radius R1 of the first set of segments 74 is arranged to be substantially the same as the outer radius of the annular groove 32 in the first metal ring 30. The outer dimension/radius R2 of the second set of segments 76 is arranged to be substantially the same as the inner radius of the annular groove 32 in the first metal ring 30. The annular liner 78 has an inner radius substantially the same as the outer radius R2 of the second set of segments 76 and an outer radius substantially the same as the inner radius R1 of the first set of segments 74. The annular liner 78 is arranged radially between the first and second sets of segments 74 and 76 respectively. The second set of segments 76 is removably secured to the annular base plate 72. The annular liner 78 is movable axially between the first and second sets of segments 74 and 76. The first and second sets of segments 74 and 76 define an annular channel 80. The annular liner 78 has a number of pins 84, which may be arranged to extend through apertures 82 in the annular base plate 72, in order to allow the annular liner 78 to be moved. The first set of segments 74 have projections 86 adjacent the inner radius R1 of the first set of segments 74 and extending away from the annular base member 72 and arranged to locate in an annular recess 33 in the first metal ring 30. The annular recess 33 is adjacent the outer radius of the annular groove 32 in the first metal ring 30.

In this example the annular base plate 72 comprises a metal, for example an aluminium alloy, and the first and second sets of segments 74 and 76 and the annular liner 78 comprise the same material as the glue for the metal-coated fibre preforms 20, for example comprise poly methyl methacrylate (PMMA) also known as perspex (RTM). However, the first and second sets of segments 74 and 76 and the annular liner 78 may comprise materials different to the glue, for example other suitable plastic materials, as long as the material may be removed with the glue during the removal of the glue. Alternatively, the first and second sets of segments 74 and 76 and the annular liner 78 may comprise a metal, as long as the metal is compatible with, the same as, the metal coating on the fibres 14 or is compatible with, the same as, the first and second metal rings 30 and 36. But, metal segments 74 and 76 make the cassette 70 heavy.

The annular base plate 72 is manufactured first and then two rings are rough machined. Each ring is located coaxially on the annular base plate 72 using a plurality of circumferentially spaced location pins, or dowels, which extend axially from the annular base plate 72. The location pins locate in corresponding apertures in the rings. Retaining bolts are fitted to secure the rings to the annular base plate 72. The bolts and location pins are removed and the annular base plate 72 and rings are separated. Each of the rings is machined to form the first and second sets of segments 74 and 76. The first and second sets of segments 74 and 76 are repositioned on the annular base plate 72 and located with the location pins and bolts. There may be any suitable number of location pins and bolts per segment 74 and 76, for example three location pins and three bolts. The segments 74 and 76 are then finish machined. The liner 78 is simply cut from sheet material and turned to size.

A plurality of the metal-coated fibre preforms 20 are stored in the cassette 70, as shown in FIG. 6, the number of metal coated fibre preforms 20 stored in the cassette 70 is the number required to reinforce the associated first metal ring 30. The metal-coated fibre preforms 20 are located in the annular channel 80 on the annular liner 78 between the first and second sets of segments 74 and 76 on the annular base plate 70. The pins 84 are removed from the cassette 70 during storage of the metal-coated fibre preforms 20 on the cassette 70. The gaps between the first and second segments 74 and 76 are to allow access to the metal coated fibre preforms 20 during loading of the metal coated fibre preforms 20 onto the cassette 70.

Figure 7:
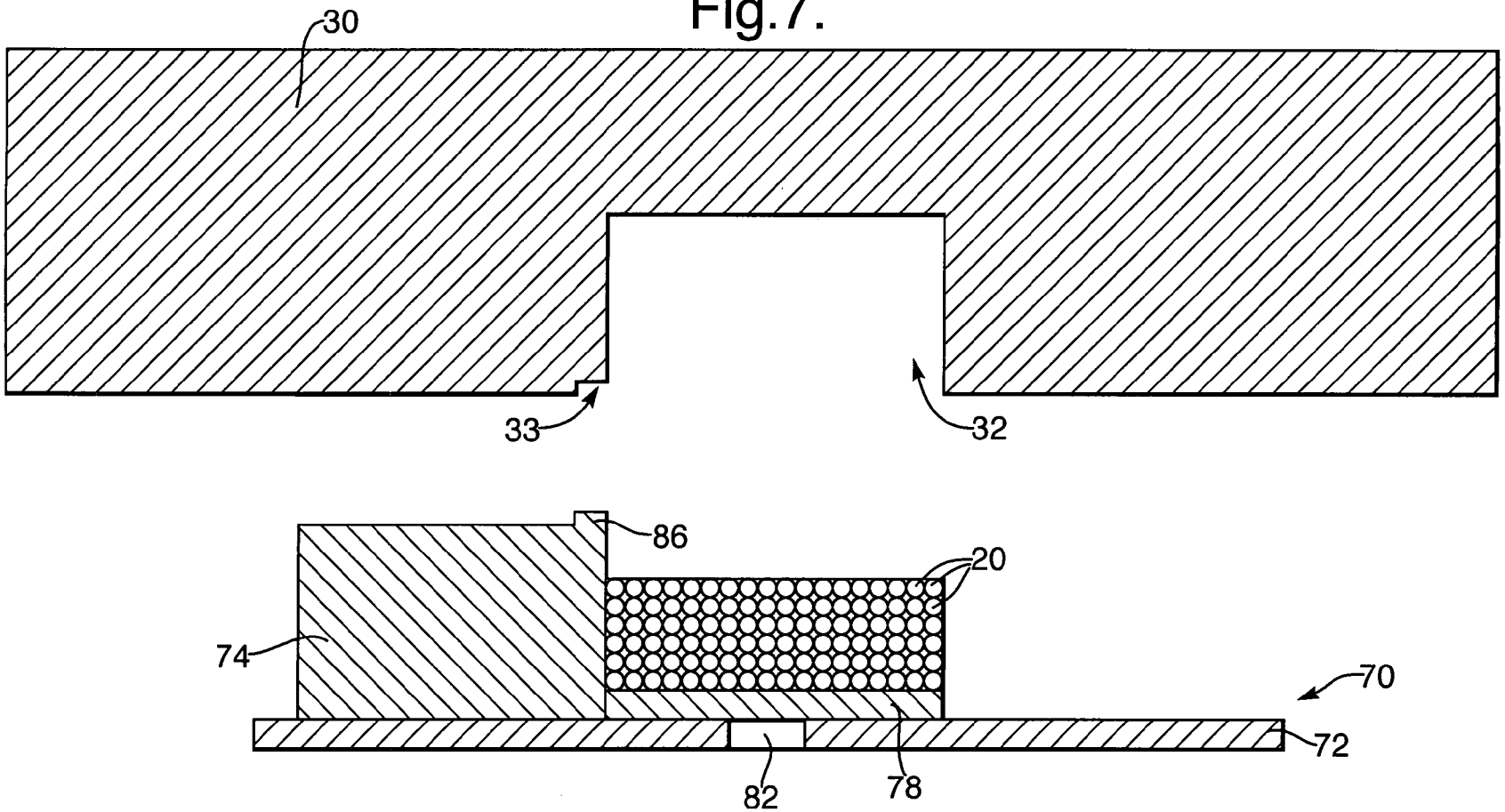
FIG. 7 is an enlarged part longitudinal, axial, cross-sectional view of the cassette and the first metal ring.
Figure 8:
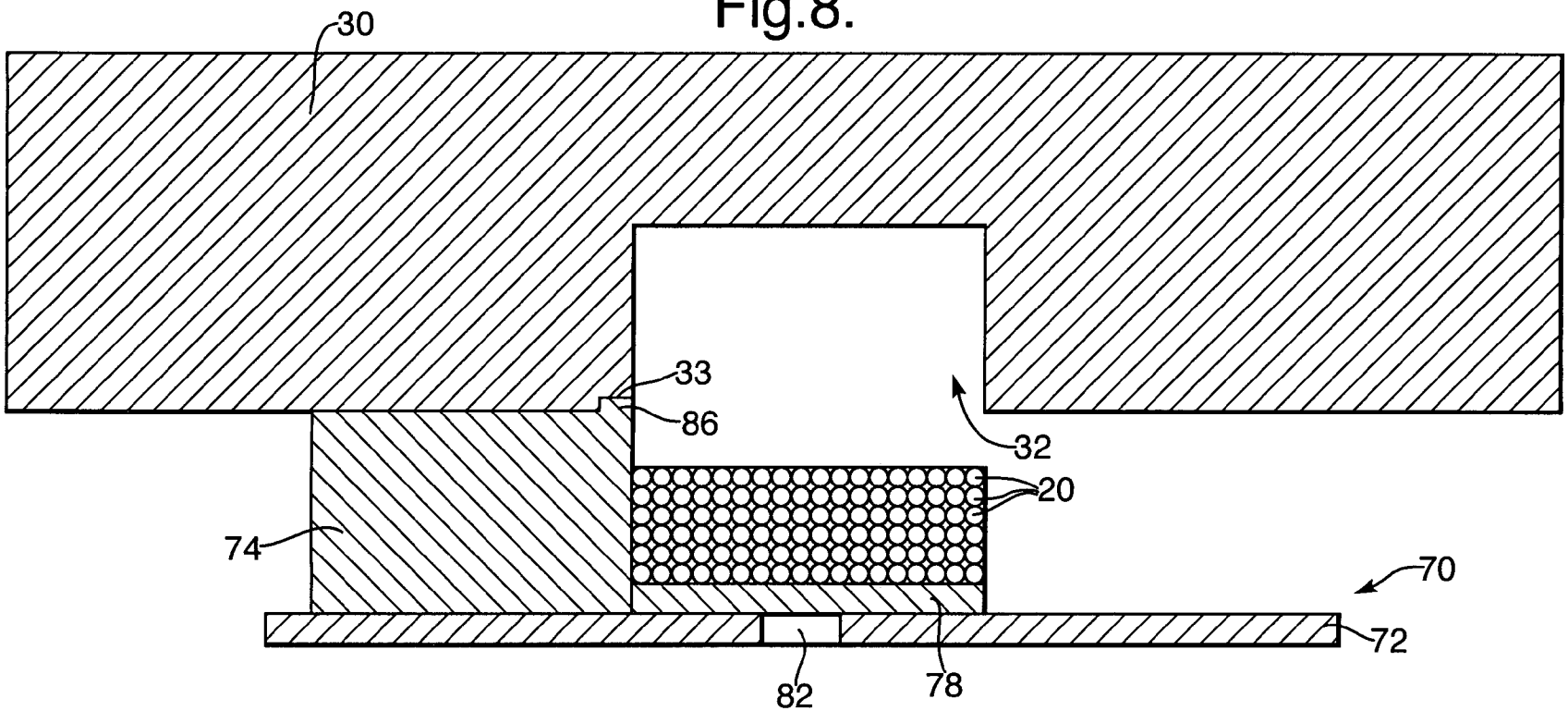
FIG. 8 is an enlarged part longitudinal, axial, cross-sectional view of the cassette located against the first metal ring.
Figure 9:
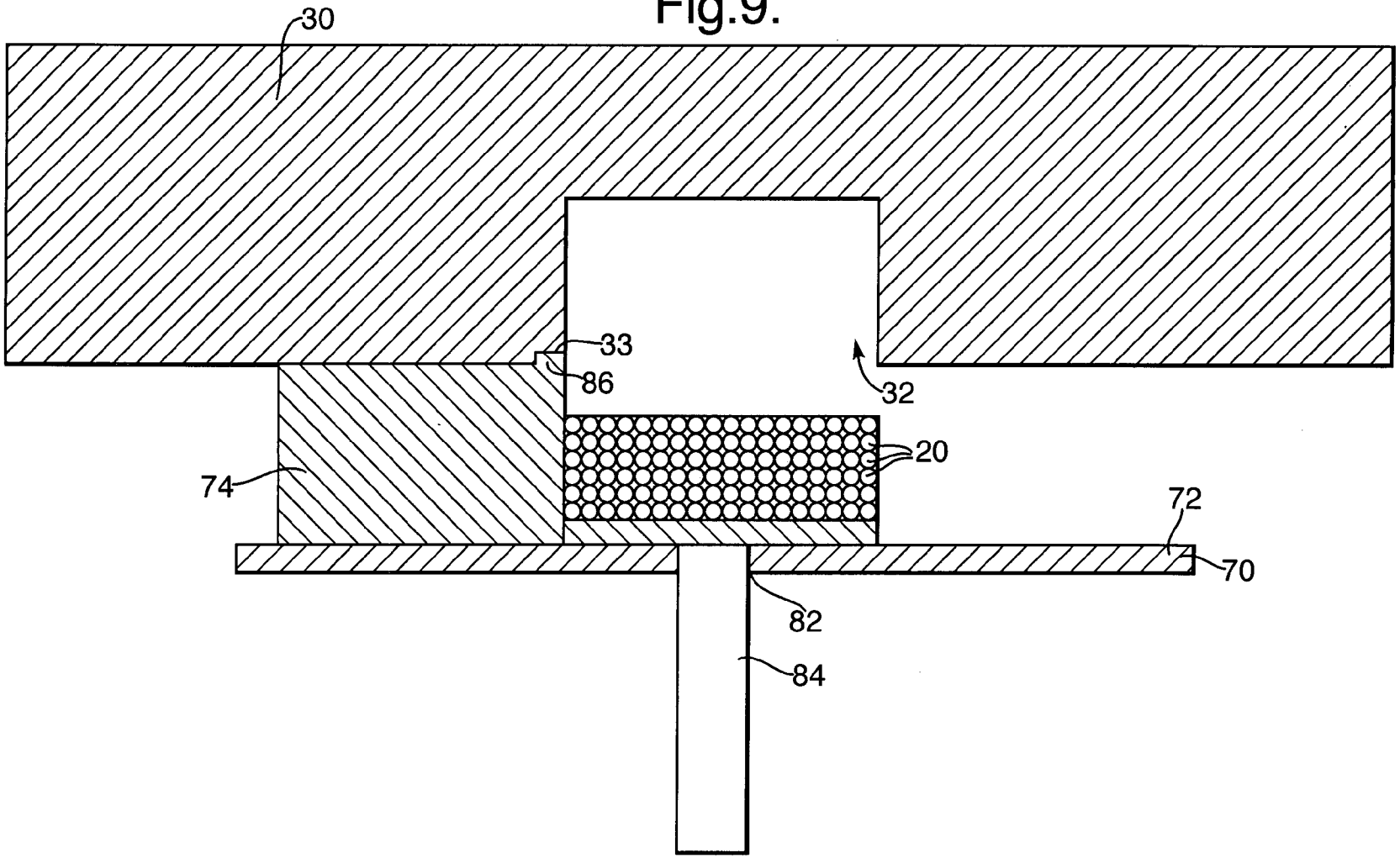
FIG. 9 is an enlarged part longitudinal, axial, cross-sectional view of the cassette located against the first metal ring after securing pins on the cassette.
Figure 10:
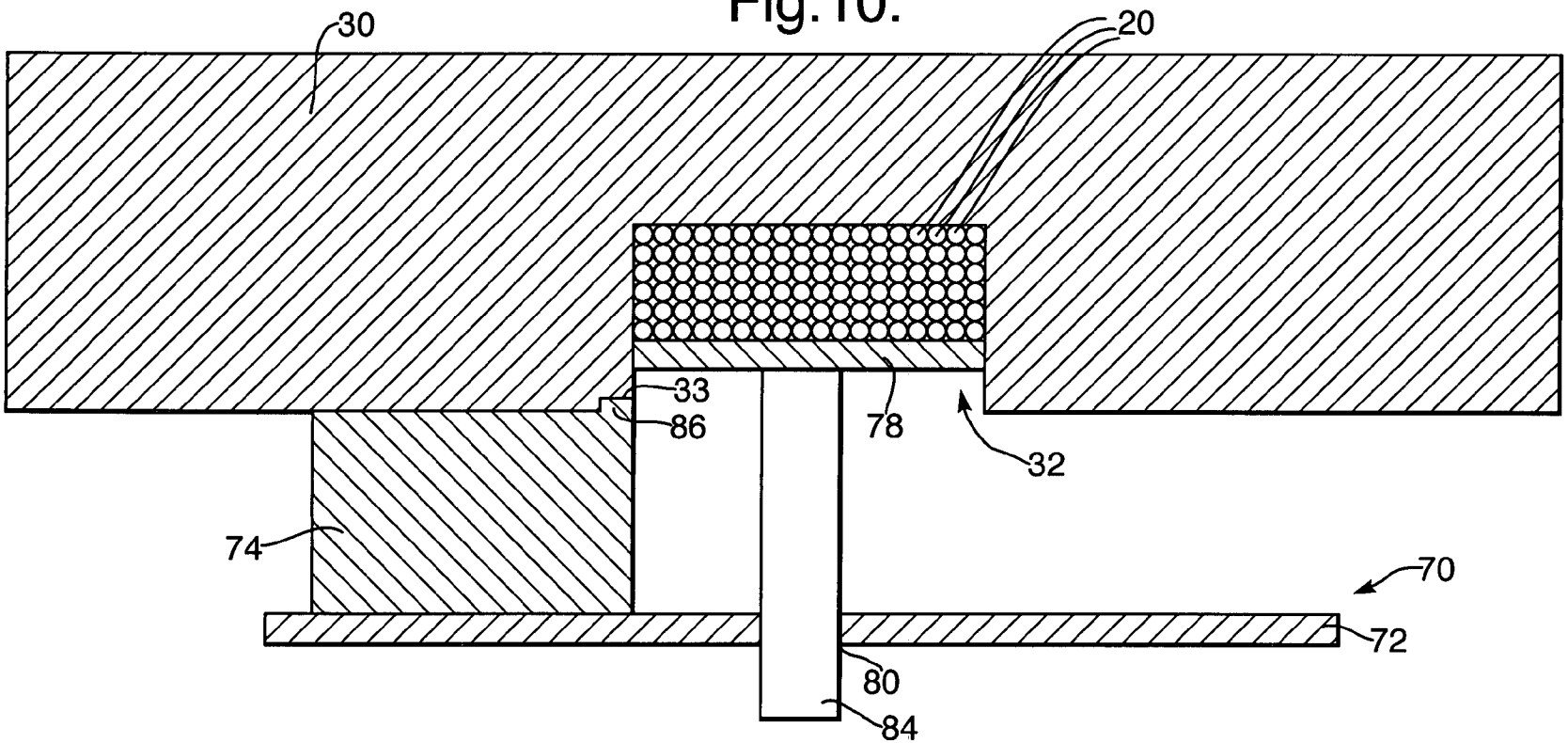
FIG. 10 is an enlarged part longitudinal, axial, cross-sectional view of the cassette located against the first metal ring after positioning fibre preforms in the first metal ring.
Figure 12:
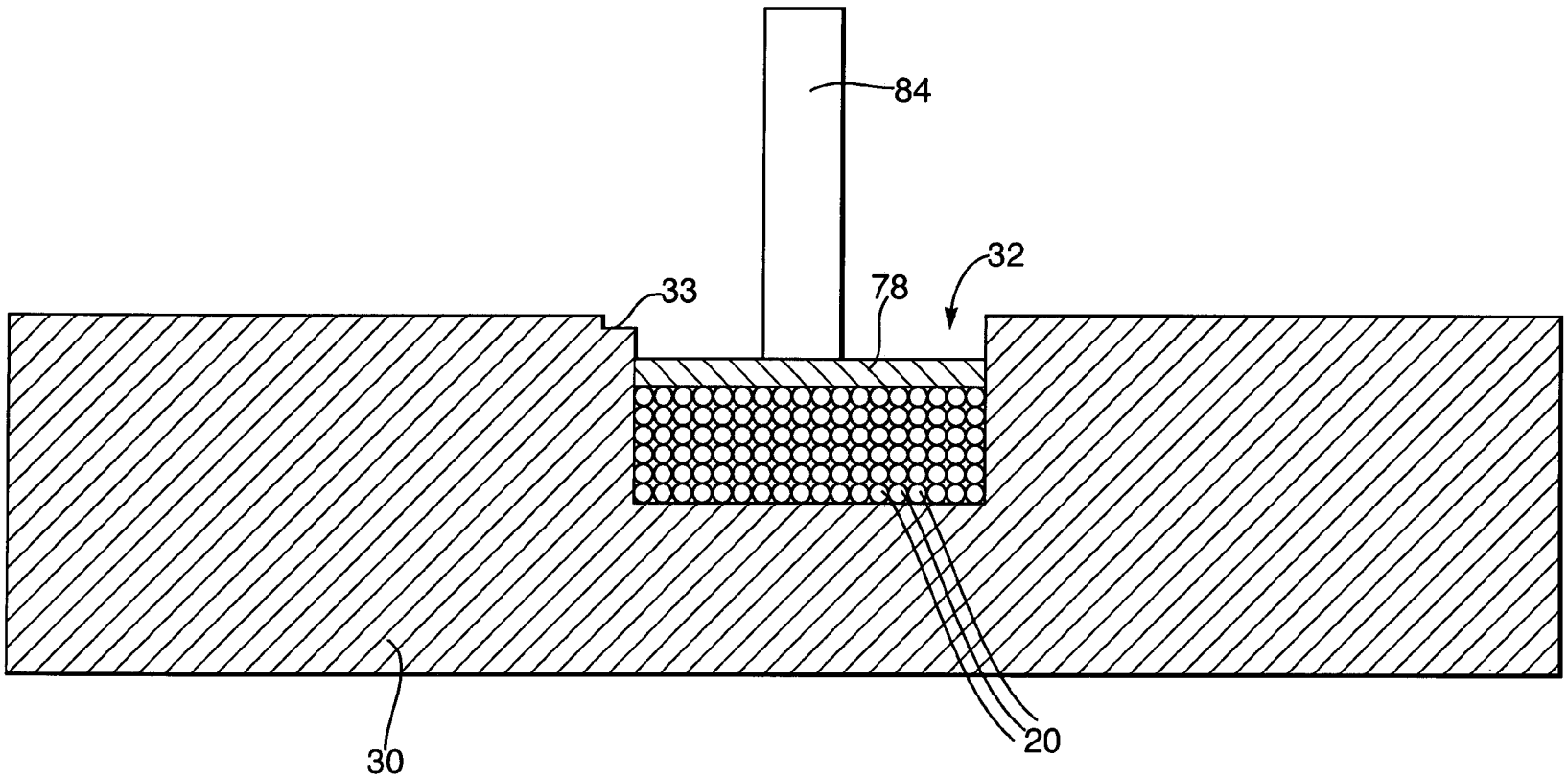
FIG. 12 is an enlarged part longitudinal, axial, cross-sectional view of the first metal ring with the fibre preforms positioned in the first metal ring after removal of the cassette.
Figure 13:
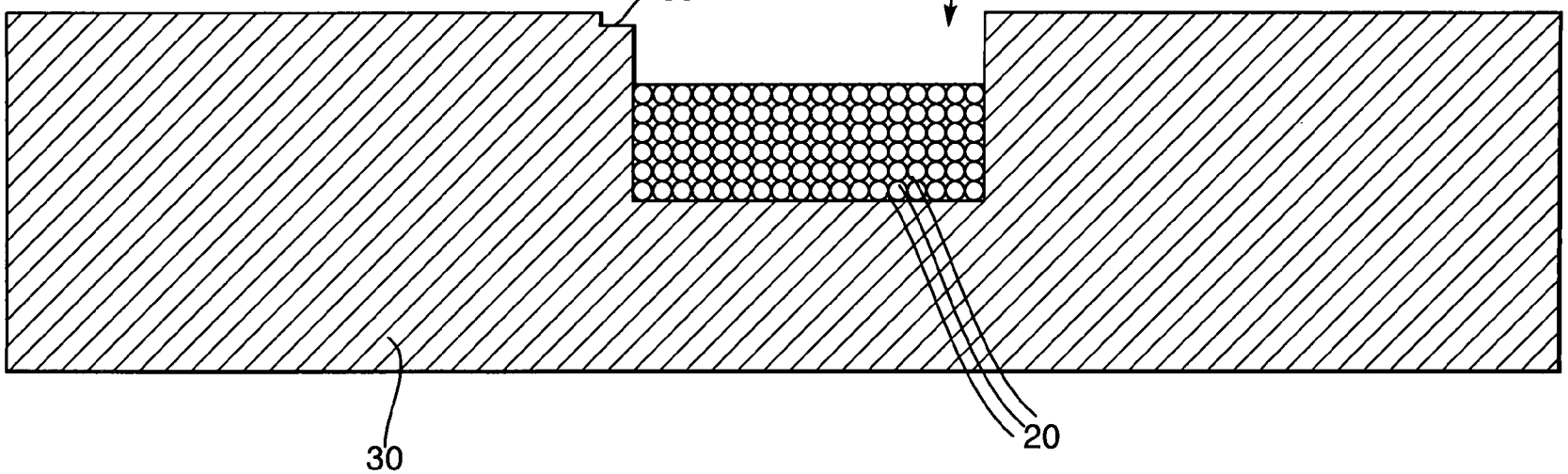
FIG. 13 is an enlarged part longitudinal, axial, cross-sectional view of the first metal ring with the fibre preforms positioned in the first metal ring after removal of the pins and liner.

The metal-coated fibre preforms 20 are placed in the annular groove 32 in the first metal ring 30 by firstly removing the second set of segments 76 from the cassette 70. The cassette 70 is positioned coaxially with the first metal ring 30 and such that the annular channel 80 in the cassette 70 faces the annular groove 32 in the first metal ring 30, as shown in FIG. 7. The cassette 70 is moved axially such that the projections 86 on the first set of segments 74 locate in the annular recess 33 in the first metal ring 30 to maintain the cassette 70 in the correct position relative to the first metal ring 30, as shown in FIG. 8. The pins 84 are inserted through the apertures 82 in the annular base plate 72 and secured to the annular liner 78, as shown in FIG. 9. The pins 84 are then moved axially relative to the first metal ring 30 such as to move the annular liner 78 and the metal-coated fibre preforms 20 towards and into the annular groove 32 in the first metal ring 30, as shown in FIG. 10. When the metal-coated fibre preforms 20 reach the closed end of the annular groove 32 in the first metal ring 30 the cassette 70, that is the annular base plate 72 and the first set of segments 74, is removed leaving the annular liner 78 and pins 84 in the annular groove 32 in the first metal ring 30, as shown in FIG. 12. Finally the annular liner 78 and the pins 84 are removed from the annular groove 32 in the first metal ring 30, as shown in FIG. 13.

Figure 11:
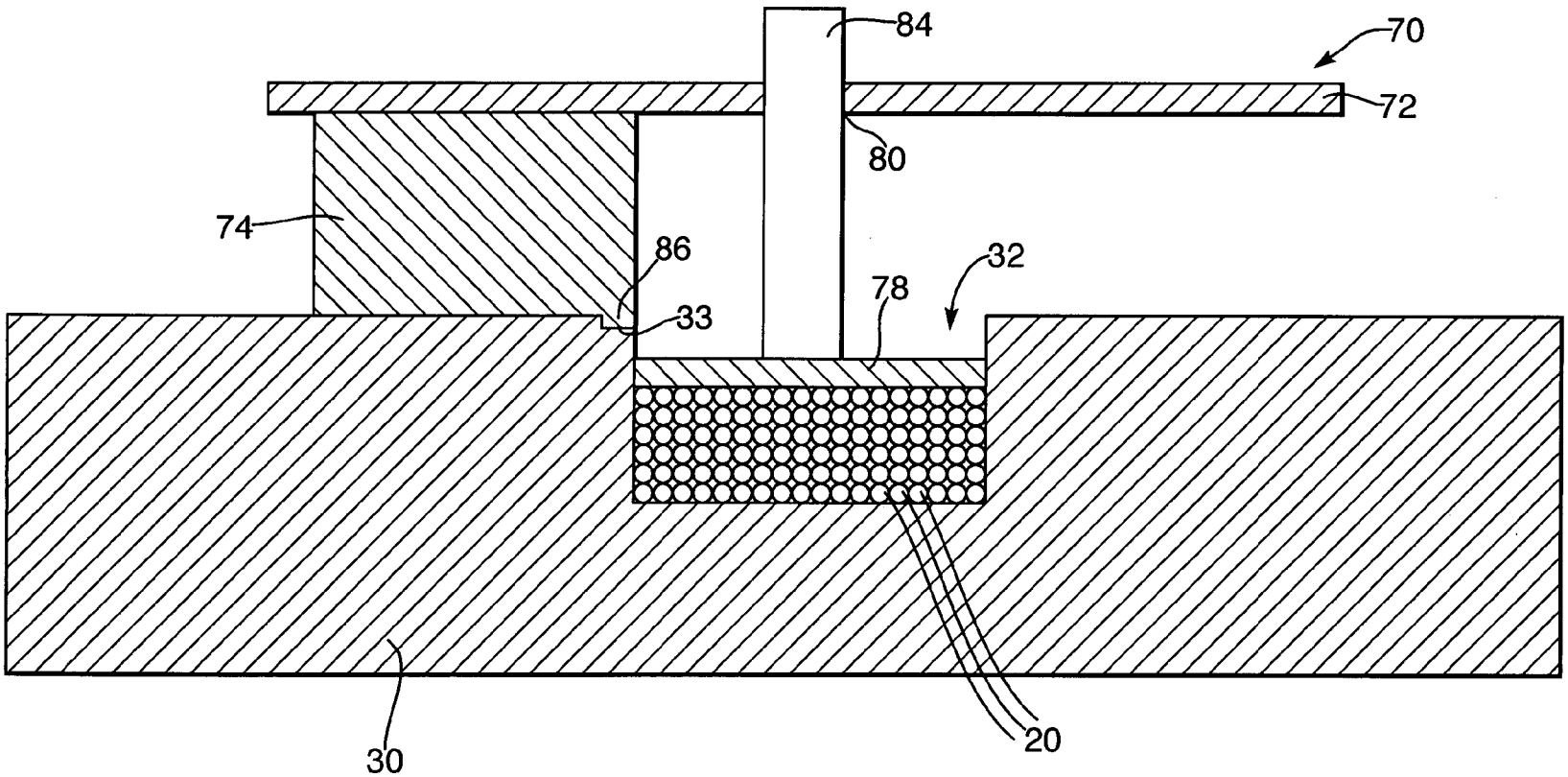
FIG. 11 is an enlarged part longitudinal, axial, cross-sectional view of the cassette located against the first metal ring with the fibre preforms positioned in the first metal ring after inverting.

During the placing of the metal-coated fibre preforms 20 in the annular groove 32 in the first metal ring 30, it is preferred that the open end of the annular channel 80 in the cassette 70 faces vertically upwards and that the open end of the annular groove 32 in the first metal ring 30 faces vertically downwards, as shown in FIGS. 8, 9 and 10. Once the metal-coated fibre preforms 20 and annular liner 78 are fully in position in the annular groove 32 in the first metal ring 30 the cassette 70 and first metal ring 30 are inverted such that the annular channel 80 in the cassette 70 faces vertically downwards and the annular groove 32 in the first metal ring 30 faces vertically upwards, as shown in FIG. 11.

The first set of segments 74 provides the location for the metal-coated fibre preforms 20 to ensure the correct positioning of the metal-coated fibre preforms 20 in the annular groove 32 in the first metal ring 30 and to ensure the metal-coated fibre preforms 20 are circular. The inner radius of the first set of segments 74 is matched to the outer radius of the annular groove 32 in the first metal ring 30 to enable the outer radius of the metal-coated fibre preforms 20 to be checked and ensure that the metal-coated fibre preforms 20 fit into the annular groove 32 in the first metal ring 32 without fouling. The projections 86 on the first set of segments 74 ensures correct alignment of the cassette 70 and first metal ring 30 during the positioning of the metal-coated fibre preforms 20 in the annular groove 32 in the first metal ring 30.

Figure 14:
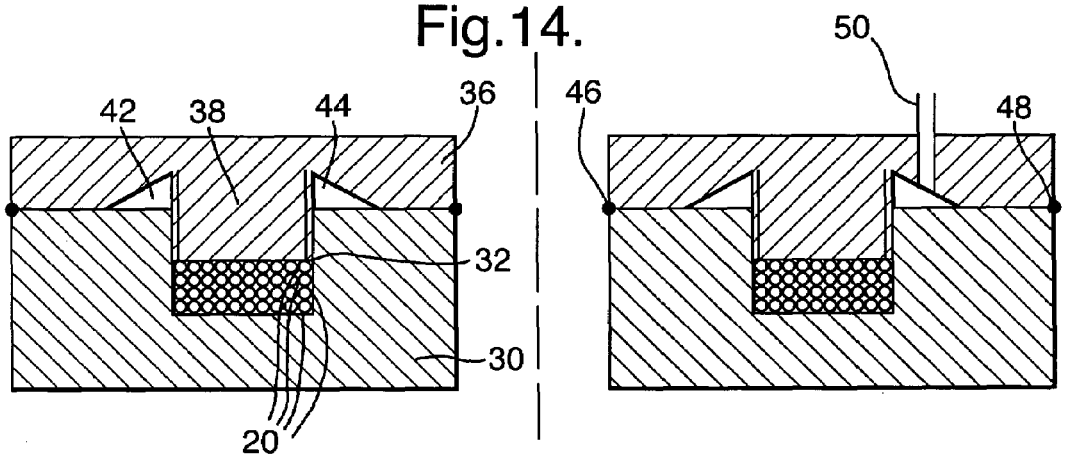
FIG. 14 is a longitudinal, axial, cross-sectional view through the assembly of fibre preforms positioned between first and second metal rings after welding together.

The second metal ring 36 is then arranged such that the face 40 confronts the face 34 of the first metal ring 30 and the axes of the first and second metal rings 30 and 36 are aligned such that the annular projection 38 on the second metal ring 36 aligns with the annular groove 32 in the first metal ring 30. The second metal ring 36 is then pushed towards the first metal ring 30 such that the annular projection 38 enters the annular groove 32 and is further pushed until the face 40 of the second metal ring 36 abuts the face 34 of the first metal ring 30, as shown in FIG. 14.

The radially inner and outer peripheries of the face 34 of the first metal ring 30 are sealed to the radially inner and outer peripheries of the face 40 of the second metal ring 36 to form a sealed assembly. The sealing is preferably by TIG welding, electron beam welding, laser welding or other suitable welding processes to form an inner annular weld seal 46 and an outer annular weld seal 48 as shown in FIG. 14.

The sealed assembly is evacuated using a vacuum pump and a pipe 50 connected to the grooves, or chambers, 42 and 44. The sealed assembly is then heated, while being continuously evacuated to remove the glue 22 from the annular fibre preforms 20 and to remove the glue 22 from the sealed assembly. Any contamination of the metal coated fibre preforms 20 with poly methyl methacrylate etc, from the first and second segments 74 and 76 or annular liner 78, is also removed from the sealed assembly during the removal of the glue.

After all the glue 22 has been removed from the annular fibre preforms 20 and the interior of the sealed assembly is evacuated, the pipe 50 is sealed at one or more positions using resistance welds. The sealed assembly is then heated and pressure is applied to the sealed assembly to produce axial consolidation of the annular fibre preforms 20 and diffusion bonding of the first metal ring 30 to the second metal ring 36 and diffusion bonding of the metal on the metal-coated 18 ceramic fibres 14 to the metal on other metal-coated 18 ceramic fibres 14, to the first metal ring 30 and to the second metal ring 36. During the application of heat and pressure the pressure acts equally from all directions on the sealed assembly, and this causes the annular projection 38 to move axially into the annular groove 32 to consolidate the annular fibre preforms 20.

Figure 15:
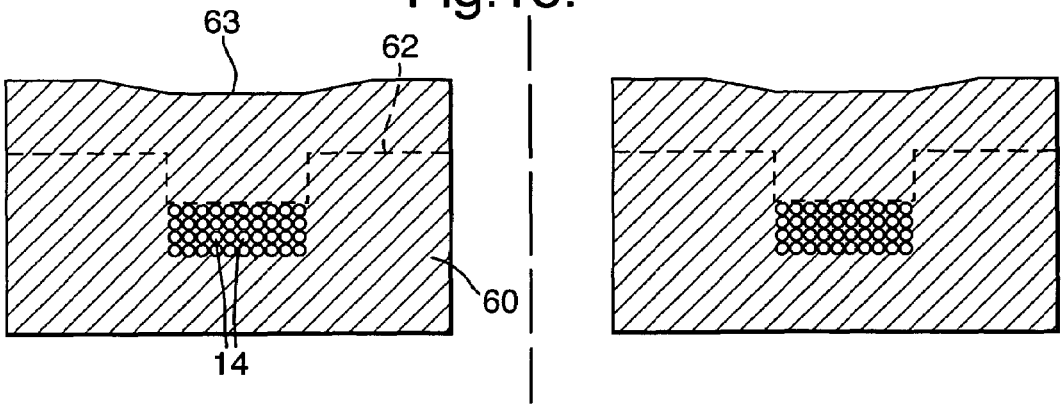
FIG. 15 is a longitudinal, axial, cross-sectional view through the assembly of fibre preforms positioned between first and second metal rings after consolidation and bonding to form a unitary composite article.

The resulting consolidated and diffusion bonded ceramic fibre reinforced component is shown in FIG. 15, which shows the ceramic fibres 14 and the diffusion bond region 62. Additionally the provision of the annular grooves, or chambers, 42 and 44 allows the annular projection 38 to move during the consolidation process and in so doing this results in the formation of a recess 63 in the surface of what was the second metal ring 36. The recess 63 indicates that successful consolidation has occurred.

After consolidation and diffusion bonding the article is machined to remove at least a portion of what was originally the first metal ring 30, at least a portion of the second metal ring 36 and at least a portion of the diffusion bonded region 62. In the example the majority of the second metal ring 36 and the majority of the diffusion-bonded region 62 is removed.

The article may then be machined for example by electrochemical machining or milling to form the integral compressor blades 16, as shown in FIG. 1, or the article may be machined to form one or more slots to receive the roots of the compressor blades.

The advantage of the present invention is that the cassette provides storage for a complete set of metal-coated fibre preforms for reinforcing one first metal ring. The cassette is sized to match the annular groove in the first metal ring to ensure that the metal-coated fibre preforms fit into the first metal ring. The cassette ensures that the metal-coated fibre preforms are held in the correct position relative to the first metal ring to ensure good fibre management. The cassette minimises handling of the metal-coated fibre preforms and hence minimises possible damage and contamination of the metal-coated fibre preforms. The cassette provides the means to insert the metal-coated fibre preforms into the first metal ring, whilst maintaining accurate location of the metal-coated fibre preforms.

Alternatively, compressor blades may be friction welded, laser welded or electron beam welded onto the article.

The reinforcing fibres may comprise alumina, silicon carbide, silicon nitride, boron or other suitable fibre.

The metal coating on the reinforcing fibre may comprise titanium, titanium aluminide, titanium alloy, aluminium, aluminium alloy, copper, copper alloy or any other suitable metal, alloy or intermetallic which is capable of being diffusion bonded.

The first metal ring and the second metal ring comprise titanium, titanium aluminide, titanium alloy, aluminium, aluminium alloy, copper, copper alloy or any other suitable metal, alloy or intermetallic which is capable of being diffusion bonded.

It may be possible for the second set of segments 76 to be fixed to the annular base plate 72 and for the first set of segments 74 to be removed to allow installation of the fibre preforms. In this instance the second set of segments 76 are provided with projections to locate in an annular recess 33 adjacent the inner radius of the annular groove 32 in the first metal ring 30. However, it is preferable for the first set of segments 74 to be fixed and the second set of segments 76 to be removable, because the first set of segments 74 prevent the spirally wound metal-coated 18 fibres 14 of the fibre preforms 20 straightening if the glue 22 is soft.

It may be possible to arrange for the second set of segments 76 to partially overlap the inner radius of the annular liner 78 so that the annular liner 78 accurately positions the second set of segments 76.

Figure 16:
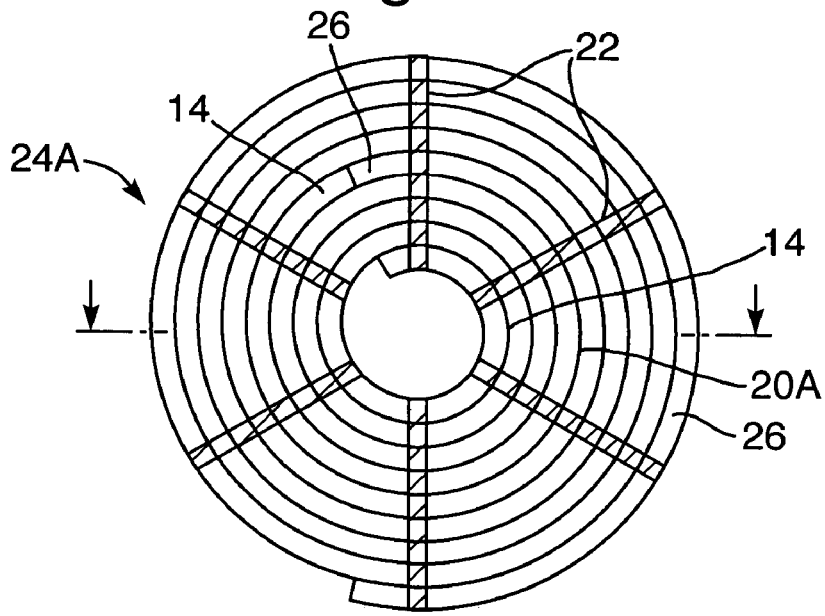
FIG. 16 is a plan view of a fibre and wire preform used in an alternative method of the present invention.
Figure 17:
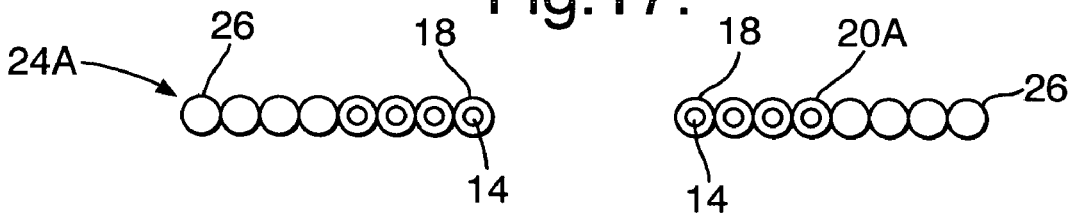
FIG. 17 is a cross-sectional view through the preform shown in FIG. 16.

Although the present invention has been described with reference to spirally wound metal coated fibres alone, the present invention is also applicable to the use of fibre preforms 20A comprising spirally wound metal-coated 18 ceramic fibres 14 and wire preforms 24A comprising spirally wound metal wires 26, as shown in FIGS. 16 and 17. In FIGS. 16 and 17 each fibre preform 20A is arranged in the same plane as an associated wire preform 24A, but each wire preform 24A is at a greater diameter. The preforms 20A and 24A may be arranged in different planes.

Additionally the present invention is applicable to the use of spirally wound fibres and metal foils, spirally wound fibres and metal powder, helically wound fibres in metal ribbon, spirally wound fibres and spirally wound metal wires or other form of metal filler.

The metal wire may comprise titanium, titanium aluminide, titanium alloy, aluminium, aluminium alloy, copper, copper alloy or any other suitable metal, alloy or intermetallic which is capable of being diffusion bonded. The metal foil, metal ribbon, metal powder or other metal filler may comprise titanium, titanium aluminide, titanium alloy, aluminium, aluminium alloy, copper, copper alloy or any other suitable metal, alloy or intermetallic which is capable of being diffusion bonded.

Although the present invention has been described with reference to providing a circumferentially extending groove in a face of a first metal ring and a circumferentially extending projection on a face of a second metal ring it is equally applicable to the provision of a circumferentially extending groove on a radially outer face, or a radially inner face, of a ring and if the circumferentially extending groove is defined by a radially extending removable member. The present invention is also applicable to the use of a plurality of fibres, or metal-coated fibres, extending in a single direction with the fibres, or metal-coated fibres, being arranged in layers and with the layers being stacked upon each other.

The present invention is also applicable to any other arrangement where the fibres are placed between two or more metal components.

Although the present invention has been described with reference to a cassette comprising a plurality of first segments and a plurality of second segments it is equally possible for the cassette to comprise a single first annular member, or ring, and a single second annular member, or ring, rather than a plurality of first segments and a plurality of second segments.

I claim:

1. A method of manufacturing a fibre reinforced metal matrix composite article, the method comprising the steps of:

(a) forming a first metal component, forming a groove in the first metal component, (b) forming a second metal component, (c) forming at least one fibre preform, the fibre preform comprising at least one fibre, (d) placing the at least one fibre preform on a cassette, the cassette having a channel to receive the at least one fibre preform, (e) arranging the cassette and the first metal component such that the channel in the cassette is aligned with and faces the groove in the first metal component, (f) moving the at least one fibre preform from the channel in the cassette to the groove in the first metal component, (g) placing the second metal component on the first metal component such that the at least one fibre preform and a filler metal are arranged between the first metal component and the second metal component, (h) sealing the second metal component to the first metal component, (i) applying heat and pressure such as to consolidate the at least one fibre preform and the filler metal and to diffusion bond the filler metal, the first metal component and the second metal component to form a unitary composite component.

2. A method as claimed in claim 1 comprising the steps of:

(a) forming a first metal component, forming an annular groove in the first metal component, (b) forming a second metal component, (c) forming at least one fibre preform, the fibre preform comprising at least one fibre, (d) placing the at least one fibre preform on a cassette, the cassette having an annular channel to receive the at least one fibre preform, (e) arranging the cassette and the first metal component such that the annular channel in the cassette is coaxial with and faces the annular groove in the first metal component, (f) moving the at least one fibre preform from the annular channel in the cassette to the annular groove in the first metal component, (g) placing the second metal component on the first metal component such that the at least one fibre preform and filler metal are arranged in the annular groove between the first metal component and the second metal component, (h) sealing the second metal component to the first metal component, (i) applying heat and pressure such as to consolidate the at least one fibre preform and the filler metal and to diffusion bond the filler metal, the first metal component and the second metal component to form a unitary composite component.

3. A method as claimed in claim 2 wherein step (e) comprises arranging the open end of the annular channel in the cassette such that it faces vertically upwards and that the open end of the annular groove in the first metal component faces vertically downwards.

4. A method as claimed in claim 3 comprising after step (f) and before step (g) inverting the cassette and the first metal component such that the annular channel in the cassette faces vertically downwards and the annular groove in the first metal component faces vertically upwards.

5. A method as claimed in claim 2 wherein the method comprises forming an annular projection on the second metal component and placing the annular projection of the second metal component in the annular groove in the first metal component.

6. A method as claimed in claim 2 wherein the cassette comprises an annular base member, a first ring and a second ring, the first ring and second ring being mounted coaxially on the annular base member to define the annular channel.

7. A method as claimed in claim 6 wherein the first ring is segmented.

8. A method as claimed in claim 6 wherein the second ring is segmented.

9. A method as claimed in claim 8, comprising removing the segments of the second ring from the cassette after step (d) and before step (e).

10. A method as claimed in claim 6 wherein the cassette comprises an annular liner positioned between the first ring and the second ring, the at least one fibre preform being positioned on the annular liner.

11. A method as claimed in claim 10 wherein step (f) comprises moving the annular liner axially relative to the cassette and the first metal component so as to move the at least one fibre preform from the annular channel in the cassette to the annular groove in the first metal component.

12. A method as claimed in claim 6 wherein the first ring has at least one projection and the first metal component has an annular recess to maintain the cassette in the correct position relative to the first metal component.

13. A method as claimed in claim 6 wherein the annular base member has a plurality of circumferentially arranged apertures arranged between the first ring and the second ring.

14. A method as claimed in claim 13 comprising inserting pins through the apertures in the annular base plate and securing the pins to the annular liner.

15. A method as claimed in claim 14 wherein step (f) comprises moving the pins axially relative to the first metal component such as to move the annular liner and the fibre preforms towards and into the annular groove in the first metal component.

16. A method as claimed in claim 14 comprising removing the annular base plate and the first ring to leave the annular liner and pins in the annular groove in the first metal component.

17. A method as claimed in claim 16 comprising removing the annular liner and the pins from the annular groove in the first metal component.

18. A method as claimed in claim 1 wherein in step (c) comprises forming at least one metal wire preform, step (d) comprises placing the at least one fibre preforms and the at least one metal wire preform in the annular channel in the cassette and step (f) comprises moving the at least one fibre preform and the at least one metal wire preform from the annular channel in the cassette to the annular groove in the first metal component.

19. A method as claimed in claim 1 wherein there are a plurality of fibre preforms.

20. A method as claimed in claim 1 wherein the sealing of the edges of the at least two metal components is by welding the edges of the at least two metal components together.

21. A method as claimed in claim 1 wherein the at least one fibre is a silicon carbide fibre, a silicon carbide fibre, a boron fibre or an alumina fibre.

22. A method as claimed in claim 1 wherein the at least one fibre is a metal-coated fibre.

23. A method as claimed in claim 22 wherein the metal-coated fibre is titanium coated fibre, a titanium aluminide coated fibre or a titanium alloy coated fibre.

24. A method as claimed in claim 1 wherein the fibre preform is formed by winding at least one fibre on a former to form a spiral fibre preform.

25. A method as claimed in claim 1 wherein the filler metal comprises at least one metal wire.

26. A method as claimed in claim 25 wherein the at least one metal wire is a wire preform.

27. A method as claimed in claim 26 wherein the wire preform is formed by winding at least one metal wire on a former to form a spiral wire preform.

28. A method as claimed in claim 26 wherein the at least one metal wire is a titanium wire, a titanium aluminide wire or a titanium alloy wire.

29. A method as claimed in claim 1 comprising storing the at least one fibre preform on the cassette.

* * * * *